US007318667B2

(12) United States Patent
Stalec et al.

(10) Patent No.: US 7,318,667 B2
(45) Date of Patent: Jan. 15, 2008

(54) PLATFORM SHAKER FOR $CO_2$ ENVIRONMENT

(75) Inventors: Lawrence Walter Stalec, Elk Grove Village, IL (US); Bradley William Stone, Yorkville, IL (US)

(73) Assignee: Lab-Line Instruments, Inc., Melrose Park, IL (US)

( * ) Notice: Subject to any disclaimer, the term of this patent is extended or adjusted under 35 U.S.C. 154(b) by 528 days.

(21) Appl. No.: 11/086,978

(22) Filed: Mar. 22, 2005

(65) Prior Publication Data

US 2006/0215487 A1 Sep. 28, 2006

(51) Int. Cl.
*B01F 11/00* (2006.01)

(52) U.S. Cl. ..... 366/208

(58) Field of Classification Search ..... 366/108–128, 366/208–219; 73/662–672
See application file for complete search history.

(56) References Cited

U.S. PATENT DOCUMENTS

| | | | | |
|---|---|---|---|---|
| 4,750,845 | A * | 6/1988 | Nabetani | 366/208 |
| 5,060,151 | A | 10/1991 | Mikyska et al. | |
| 5,375,927 | A | 12/1994 | Hermsen et al. | |
| 5,564,826 | A * | 10/1996 | Neumann et al. | 366/219 |
| 5,593,228 | A * | 1/1997 | Tannenbaum | 366/209 |
| 5,641,229 | A * | 6/1997 | McClintock et al. | 366/208 |
| 2006/0215487 | A1 * | 9/2006 | Stalec et al. | 366/208 |

FOREIGN PATENT DOCUMENTS

| | | | |
|---|---|---|---|
| GB | 1199840 | * | 7/1970 |
| JP | 11-165130 | * | 6/1999 |
| JP | 2002-153742 | * | 5/2002 |
| JP | 2004-154651 | * | 6/2004 |

OTHER PUBLICATIONS

New Brunswick Scientific, Biological Shakers for Your Lab, http://www.nbsc.com/shakers.aspx, date unknown.*
Witec AG, Shakers/Incubators, http://www.witec.ch/E/prod list.php?id=1720, 2007.*
Sandstrom Product Company, *9A Solid Film Lubricant-Heat Curing*, Technical Information Guide, 2 pages Feb. 1, 1998.
Barnstead International, *News Center*, http://www.barnsteadthermolyne.com, 2000.

* cited by examiner

*Primary Examiner*—Charles E. Cooley
(74) *Attorney, Agent, or Firm*—Wood, Herron & Evans, L.L.P.

(57) ABSTRACT

A platform shaker for use in a $CO_2$ rich environment that has a corrosion resistant output shaft and a corrosion resistant, sealed motor casing. An eccentric drive assembly is connected between the output shaft and a platform and has components treated with a corrosion inhibiting coating. A shaker control controls the electric motor has components treated with a conformal coating.

17 Claims, 1 Drawing Sheet

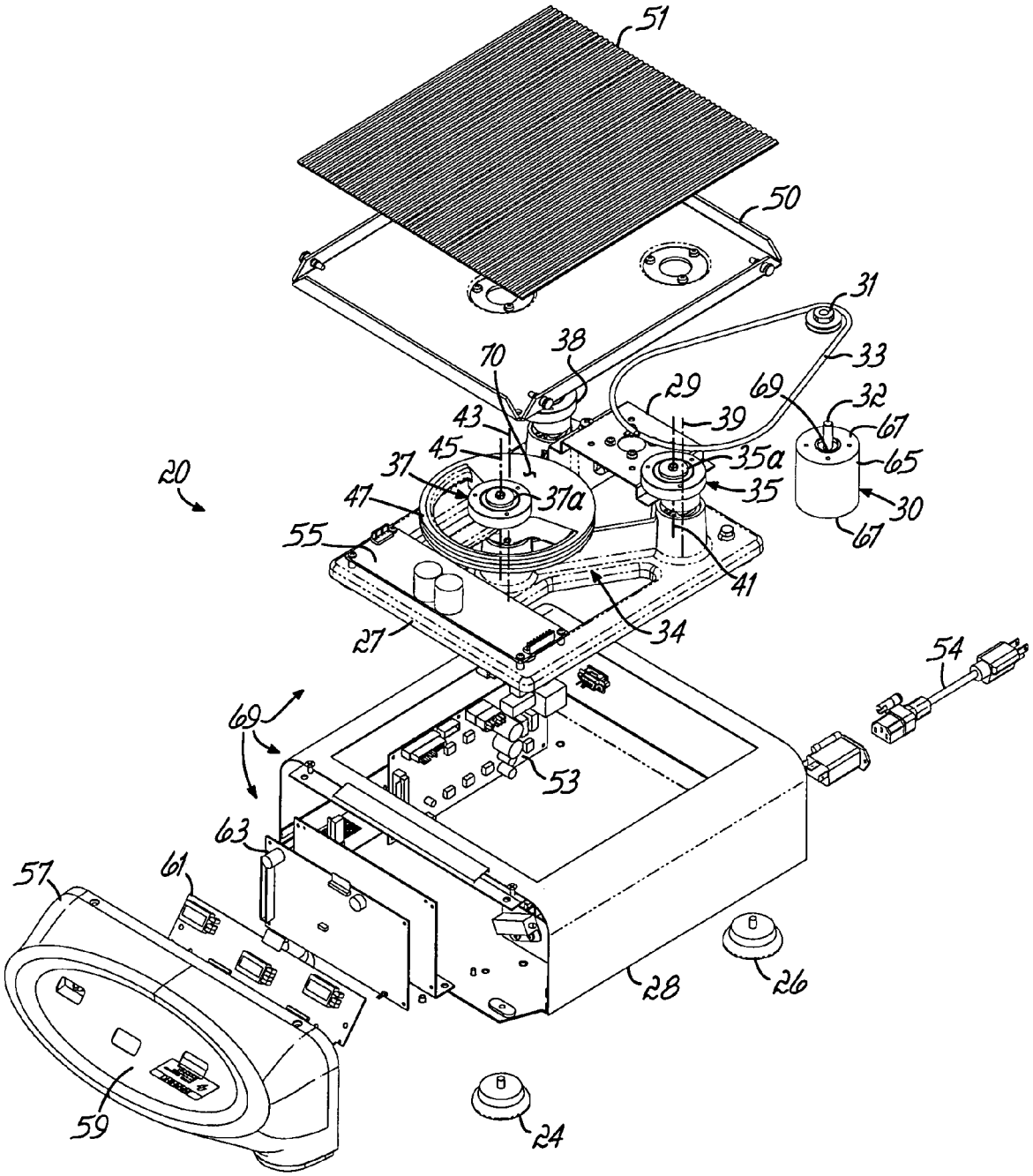
51
50
31
33
38
70
29
69
32
39
67
43
45
35a
65
37
37a
35
20
30
47
67
55
41
34
27
54
69
53
63
57
61
28
26
59
24

PLATFORM SHAKER FOR $CO_2$ ENVIRONMENT

FIELD OF THE INVENTION

This invention relates generally to laboratory equipment and more particularly, to a platform shaker that is intended for use in a carbon dioxide environment.

BACKGROUND OF THE INVENTION

Platform mixers or shakers are widely used in the chemical, medical, food and agricultural technology industries. Platform shakers can be used in incubators, warm rooms, environmental chambers and refrigerators for a wide range of applications including but not limited to solubility studies, extraction procedures, cell cultures, genetics research, bacterial suspensions, staining, detstaining and washing procedures. Most often, a platform shaker has a motor that is mounted on a stationary base. An eccentric drive with a counterweight supports a platform and is operatively connected to an output shaft of the motor. Therefore, as the motor output shaft is rotated, a mixing or shaking motion is imparted to the platform, thereby mixing or shaking a liquid or other material in a vessel supported on the platform.

In some laboratory applications, it is desirable to place the platform shaker in a carbon dioxide ("$CO_2$") incubator for mammalian cell culture. Often, when a known platform shaker is placed inside a $CO_2$ incubator, the electrical components react with the $CO_2$ and humidity in the incubator to form carboxylic acid. The carboxylic acid is highly corrosive to the metal components inside the platform shaker; and eventually, the electrical components short out causing the platform shaker to stop. In addition, the metallic mechanical components corrode from the elevated humidity and ph levels, and often mating parts experiencing relative motion or rotation will seize or lock up. The net result is that the platform shaker has a relatively short useful life compared to platform shakers operating in a non-$CO_2$ rich environment. One solution to the above problem is to provide a platform shaker having a sealed housing that prevents the $CO_2$ rich environment from reaching the interior of the shaker and contacting the electrical and mechanical components. Considering the requirement of relative motion between the platform and the stationary base, sealing the platform shaker is difficult and costly.

Therefore, there is a need for a platform shaker with an unsealed or open-to-atmosphere design that can be used in a $CO_2$ rich environment and experience a longer useful life than known platform shakers.

SUMMARY OF THE INVENTION

The present invention provides a platform shaker with an open-to-atmosphere housing that is suitable for long term operation in a $CO_2$ rich environment. The platform shaker of the present invention is especially useful in a $CO_2$ incubator used for mammalian cell culture.

According to the principles of the present invention and in accordance with the described embodiments, the invention provides a platform shaker for use in a $CO_2$ rich environment. The shaker has an electric motor supported in a housing. The motor has a corrosion resistant output shaft and a corrosion resistant, sealed motor casing. The output shaft is sealingly mounted in the motor casing to prevent corrosion of components therein. An eccentric drive assembly is connected between the output shaft and a platform, and the eccentric drive assembly has components treated with a corrosion inhibiting coating. A shaker control controls the electric motor, and the shaker control has components treated with a conformal coating. Therefore, the electric motor, eccentric drive and shaker control are protected from harmful effects resulting from the shaker being in a $CO_2$ rich environment.

In one aspect of this invention, the sealed motor casing is treated with a non-dyed, Type 1, chromic acid coating, and the output shaft is made from a passivated stainless steel. Further, the motor uses double lip, contact type rubber sealed bearings. In another aspect of the invention, the components of the eccentric drive assembly are treated with a heat cured, dry film lubricant corrosion inhibiting coating.

These and other objects and advantages of the present invention will become more readily apparent during the following detailed description taken in conjunction with the drawings herein.

BRIEF DESCRIPTION OF THE DRAWINGS

The FIGURE is a disassembled perspective view of an exemplary platform shaker in accordance with the principles of the present invention.

DETAILED DESCRIPTION OF THE INVENTION

Referring to the FIGURE, a shaker 20 is designed to be located on a bench top and supported by respective pairs of front and rear feet 24, 26. A housing 28 supports an internal base 27 and a motor mounting bracket 29. An electric motor 30 is suspended from the bracket 29 and has an output shaft 32 extending therethrough. A drive pulley 31 is fixed on the output shaft 32; and drive pulley 31 is operatively connected to an eccentric drive assembly 34 made up of the internal base 27, housed bearings 35, 37, 38 and an eccentric pulley 47 that is rotatably mounted on the base 27 and has an integral counterweight 70. Housed bearing 37 can be made integral with the eccentric pulley 47 or otherwise connected thereto. The housed bearings 35, 37 are fastened to the platform 50 and have respective centrally located idler shafts 35*a*, 37*a* that are rotatable relative to the platform 50. A drive belt 33 is looped around motor pulley 31 and the eccentric pulley 47. As the eccentric pulley 47 is rotated about the idler shaft 37*a* with respect to an axis of rotation 45, the eccentric pulley 47, idler shaft 37*a* and counterweight 70 rotate about an axis of rotation 43. That action moves the platform 50 in an orbital or other motion in a known manner, which is effective to shake material in a vessel (not shown) supported on the platform 50. Idler shaft 35*a*, being rotatable within a housed bearing 35 with respect to an axis of motion 41, follows the motion of the platform 50 by rotating about an axis of rotation 39. Housed bearing 38 is identical to housed bearing 35 and has an idler shaft (not shown) that follows the motion of the platform 50 in a similar manner as idler shaft 35*a*. The platform 50 has a cover 51 made of rubber or other material providing a higher friction, nonslip surface.

A microprocessor and power supply printed circuit ("PC") board 53 is electrically connected to an AC power cord 54. A motor drive PC board 55 is electrically connected to PC board 53 and is operative to control the operation of the motor 30. The housing 28 has a user input/output ("I/O") interface 57 that is attachable to the housing 28 and forms its front wall. The user I/O interface 57 has various devices that permit the operator to command the operation of the shaker 20, as well as view representations of its operating state. In one embodiment, the user I/O interface 57 comprises a front panel 59 that provides pushbuttons and other switches permitting an operator to provide operating commands to the shaker 20. The front panel 59 further provides LEDs, lights and other displays permitting the operator to monitor shaker operating status, etc. In another embodiment, the front panel 59 may be a touch screen. The user I/O interface 57 is connected to a PC board 61 that, in turn, is connected to a PC board 63. The PC boards 53, 55, 61, 63 are electrically interconnected by mating connectors and/or electrical cables (not shown) in a known manner and collectively function as a shaker control 69.

In contrast to known platform shakers, in the shaker 20, the mechanical components, for example, the base 27, the counterweight pulley 37, counterweight 47, etc., are treated with a heat cured, solid film, corrosion inhibiting coating per SAE standard AS5272. One example of such a coating is a Sandstrom 9A dry film lubricant commercially available from Sandstrom Products Co., Port Byron, Ill. As will be appreciated, other coatings and methods of protecting the mechanical components may be used that provide similar and adequate component protection in a $CO_2$ rich environment.

The drive motor 30 is a sealed brushed DC motor having a passivated stainless steel output shaft 32 and a non-dyed, Type 1, chromic acid coating on a motor casing comprising a motor housing 65 and end caps 67. The motor bearings, one of which is located at 69, are sealed with a double lip, contact type rubber seal; and the motor magnet is epoxy coated. A PC board (not shown) internal to the motor 30 has a Humiseal 1831 conformal coating. Thus, the motor 30 is sealed to prevent the $CO_2$ from substantial contact with components within the motor casing. Other methods of protecting the motor 30 from the $CO_2$ rich environment may be employed providing the desired adequate protection is achieved.

The electrical components, contacts and connections, for example, PC boards 53, 55, 61, 63, are treated with a clear conformal coating that seals the electronic components from moisture caused by the elevated humidity in the incubation chamber thus substantially reducing the probability of electrical malfunction. One example of a conformal coating that meets MIL-C-17504V and TT-L-50G Type I and III is KRYLON® #1301 spray coating. Other coatings and methods may be used to seal the electronic components and PC boards that provide the desired protection from the $CO_2$ rich environment.

In use, the shaker 20 can be placed in a $CO_2$ incubator or otherwise exposed to a $CO_2$ rich environment and not experience undue wear. Even though the shaker housing 28 is not sealed and open-to-atmosphere, penetration of the $CO_2$ rich environment into the shaker housing 28 does not substantially reduce the shaker's useful life. The sealed structure of the motor 30, its construction from anticorrosive materials and the conformal coating on its electrical components protect it from humidity, carboxylic acid and other harmful effects of the $CO_2$ rich environment. Further, the corrosion inhibiting dry film lubricant coating on the mechanical components protect them from the humidity, corrosive effects of carboxylic acid and other harmful effects that can be created by the $CO_2$ rich environment. In addition, conformal coating the PC boards 53, 55, 61, 63 protects the electrical components from humidity, carboxylic acid and other harmful effects of the $CO_2$ rich environment. Therefore, the shaker 20 is suitable for long term operation in a $CO_2$ rich environment and is especially useful in a $CO_2$ incubator used for mammalian cell culture.

While the invention has been illustrated by the description of one embodiment and while the embodiment has been described in considerable detail, there is no intention to restrict nor in any way limit the scope of the appended claims to such detail. Additional advantages and modifications will readily appear to those who are skilled in the art. For example, the embodiment shown and described in the FIGURE utilizes a digital user I/O interface 57; however in an alternative embodiment, the user I/O interface 57 may include analog input devices mounted on PC board 61, for example, a knob 96 connected to a potentiometer 97, a meter display, etc.

Therefore, the invention in its broadest aspects is not limited to the specific details shown and described. Consequently, departures may be made from the details described herein without departing from the spirit and scope of the claims which follow.

What is claimed is:

1. A platform shaker for use in a $CO_2$ rich environment comprising:

a housing;

a platform adapted to support an article;

an electric motor supported in the housing and comprising a corrosion resistant output shaft, and a corrosion resistant, sealed motor casing, the output shaft being sealingly mounted in the motor casing to prevent corrosion of components within the motor casing;

an eccentric drive assembly connected between the output shaft and the platform, the eccentric drive assembly comprising components treated with a corrosion inhibiting coating; and a shaker control electrically connected to the electric motor for controlling an operation of the electric motor, the shaker control comprising components treated with a conformal coating, the electric motor, eccentric drive and shaker control are protected from harmful effects resulting from the shaker being in a $CO_2$ rich environment.

2. The shaker of claim 1 wherein the sealed motor casing and the output shaft are made from corrosion resistant materials.

3. The shaker of claim 1 wherein the sealed motor casing and the output shaft are coated with corrosion resistant materials.

4. The shaker of claim 1 wherein the electric motor comprises a sealed brushed DC motor.

5. The shaker of claim 1 wherein the sealed motor casing comprises a motor housing, at least one end cap and a non-dyed, Type 1, chromic acid coating on the motor housing and the at least one end cap.

6. The shaker of claim 1 wherein the output shaft comprises a passivated stainless steel.

7. The shaker of claim 1 wherein the electric motor comprises at least one double lip, contact type rubber sealed bearing for sealing the output shaft in the motor casing.

8. The shaker of claim 1 wherein the electric motor further comprises an epoxy coated motor magnet.

9. The shaker of claim 1 wherein the electric motor further comprises a PC board coated with a conformal coating.

10. The shaker of claim 1 wherein the eccentric drive assembly comprises components treated with a heat cured, solid film corrosion inhibiting coating.

11. The shaker of claim 10 wherein the corrosion inhibiting coating comprises a dry film lubricant.

12. The shaker of claim 10 wherein the corrosion inhibiting coating is applied in accordance with SAE standard AS5272.

13. The shaker of claim 1 wherein the components of the shaker control comprise a plurality of PC boards and the conformal coating of the plurality of PC boards meet performance requirements of MIL-C-17504B.

14. The shaker of claim 13 wherein the conformal coating of the PC boards further meet performance requirements of TT-L-50G.

15. A platform shaker for use in a $CO_2$ rich environment comprising:

a housing;

a platform adapted to support an article;

a brushed DC motor supported in the housing and comprising a passivated stainless steel output shaft, and a sealed motor casing comprising a non-dyed, Type 1, chromic acid coating, the output shaft being sealingly mounted in the motor casing to prevent corrosion of components within the motor casing;

an eccentric drive assembly connected between the output shaft and the platform, the eccentric drive assembly comprising components treated with a heat cured, solid film corrosion inhibiting coating; and a shaker control electrically connected to the electric motor for controlling an operation of the electric motor, the shaker control comprising components treated with a conformal coating, the electric motor, eccentric drive and shaker control are protected from harmful effects resulting from the shaker being in a $CO_2$ rich environment.

16. The shaker of claim 15 wherein the electric motor comprises at least one double lip, contact type rubber sealed bearing for sealing the output shaft in the motor casing.

17. The shaker of claim 16 wherein the corrosion inhibiting coating comprises a dry film lubricant.

* * * * *

UNITED STATES PATENT AND TRADEMARK OFFICE

CERTIFICATE OF CORRECTION

PATENT NO. : 7,318,667 B2
APPLICATION NO. : 11/086978
DATED : January 15, 2008
INVENTOR(S) : Stalec et al.

It is certified that error appears in the above-identified patent and that said Letters Patent is hereby corrected as shown below:

In column 2, title page, (57) Abstract, line 6, change "shaker control controls the electric motor has components" to --shaker control controls the electric motor and has components--.

In column 1, line 36, change "and ph levels," to --and pH levels,--.

In column 4, line 6, change "restrict nor in any way" to --restrict or in any way--.

Signed and Sealed this

Eighth Day of July, 2008

JON W. DUDAS
*Director of the United States Patent and Trademark Office*